United States Patent [19]

Peyre

[11] Patent Number: 4,773,669

[45] Date of Patent: Sep. 27, 1988

[54] HEEL HOLD-DOWN DEVICE FOR SAFETY SKI BINDINGS

[75] Inventor: Henri Peyre, Nevers, France

[73] Assignee: Sté Look, Nevers, France

[21] Appl. No.: 917,061

[22] Filed: Oct. 9, 1986

[30] Foreign Application Priority Data

Oct. 9, 1985 [FR] France ..... 85 14938

[51] Int. Cl.[4] ..... A63C 9/08

[52] U.S. Cl. ..... 280/632

[58] Field of Search ..... 280/625, 626, 631, 632, 280/623

[56] References Cited

U.S. PATENT DOCUMENTS

| | | | |
|---|---|---|---|
| 3,550,996 | 12/1970 | Marker et al. | 280/626 |
| 3,733,082 | 5/1973 | Murata et al. | 280/632 |
| 3,773,341 | 11/1973 | Mimeur | 280/632 |
| 3,810,644 | 5/1974 | Beyl | 280/632 |
| 3,836,163 | 9/1974 | Hashioka | 280/632 |
| 4,066,277 | 1/1978 | Murata | 280/626 |

FOREIGN PATENT DOCUMENTS

| | | |
|---|---|---|
| 119518 | 2/1984 | European Pat. Off. . |
| 2021055 | 7/1970 | France . |
| 2338060 | 8/1977 | France . |
| 2659369 | 1/1978 | Fed. Rep. of Germany . |
| 2027412 | 8/1980 | Fed. Rep. of Germany . |

*Primary Examiner*—John J. Love
*Assistant Examiner*—Michael Mar
*Attorney, Agent, or Firm*—Oblon, Fisher, Spivak, McClelland & Maier

[57] ABSTRACT

The heel hold-down device, notably for safety ski bindings, comprises a fixed body, a tilting heel retaining member, a control lever, and an elastic mechanism incorporating an axial coil compression spring. The fixed body has two lateral vertical walls and is operatively connected to a movable U-shaped piston of which the two flat side arms are adapted to slide parallel to the vertical walls of the body. The heel retaining member is pivoted to the side arms of the piston by means of a pair of trunnions engaging registering holes formed in the side walls of the heel retaining member and in the piston arms. The trunnions are also slidably engaged in longitudinal slots formed in the lateral walls of the fixed body.

11 Claims, 5 Drawing Sheets

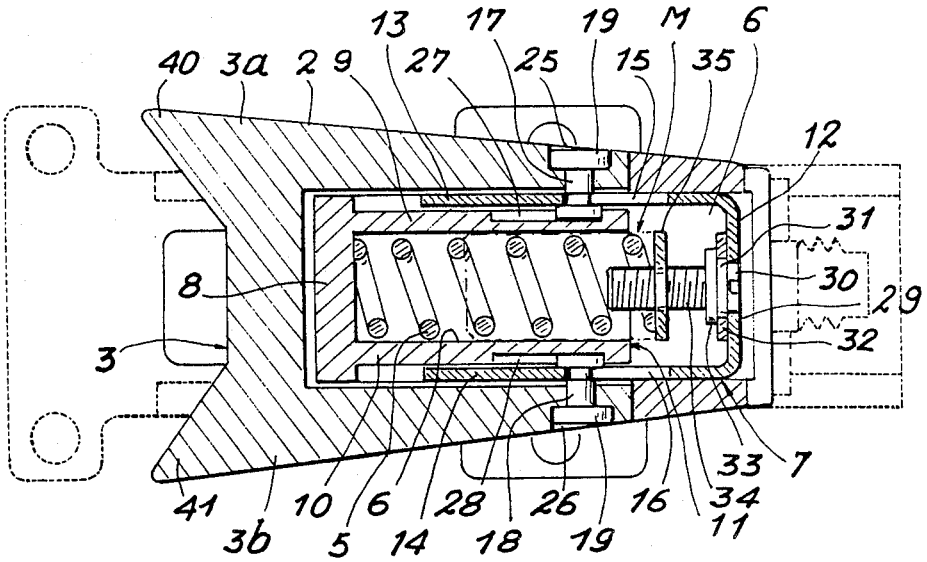
FIG. 2
FIG. 8
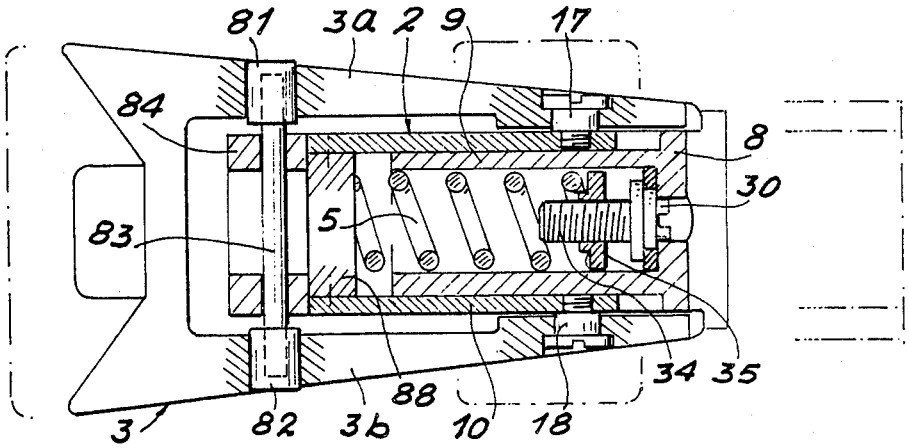

HEEL HOLD-DOWN DEVICE FOR SAFETY SKI BINDINGS

BACKGROUND OF THE INVENTION

1. Field of the Invention:

The present invention relates to safety ski bindings and has specific reference to a heel hold-down device or retainer therefor—that is, a device adapted to hold down the heel portion of a ski boot engaged in the binding and locked in the skiing position between the heel device and a toe or stop member disposed at the front end of the ski binding.

This invention relates more particularly, among heel hold-down or retaining devices known in the art, to those comprising a fixed body locked in an adjustable position on the top surface of the ski and a sole engaging member pivoted to the body and comprising in a known fashion a tongue adapted to lock the binding with the assistance of the boot heel, and a pair of lateral arms or jaws overlying the tongue and surrounding partially the edge of the ski boot sole, so that, whent he sole engaging member is tiled upwards about a transverse axis located at the rear with respect to the heel, the heel can be raised together with the sole engaging member and released from the binding. During this movement, the ski boot is caused to pivot about a fictitious axis adjacent the toe end thereof so as to cause the rotation of the sole engaging member against the force of the spring means constantly urging the sole engaging member to its operative position. The sole engaging member is associated with a control level which, when actuated by the skier, causes this member to pivot upwards and thus release the boot heel as mentioned hereinabove. On the other hand, in case of fall, notably a forward fall, of the skier, during which the skier heel is also moved upwards, the sole engaging member can likewise pivot against the force of resilient means enclosed in the fixed body, so that, when a predetermined release threshold is overstepped, the heel will again be released from the heel hold-down or retaining device.

2. The Prior Art

Many forms of embodiment of heel hold-down or retaining devices of this general type are already known in the art. In most cases, the pivotal movement of the heel engaging member takes place against the resilient force of a spring-loaded mechanism enclosed and mounted in the fixed body, or bearing against it. In this case, the sole retaining member is guided during its upward movement by causing a cross member or a pair of external pivot-pins carried by the sole retaining member to slide in curved recesses or against a ramp of suitable contour formed in or on the fixed body. Moreover, and according to an arrangement also well known in the art, the axis about which the sole retaining member pivots on the fixed body is movably mounted in an elongated groove formed in the fixed body, so that the pivotal movement of the sole retaining member is attended by a substantially axial movement of the side retaining member in conjunction, according to cases, with a forward or backward movement of the sole retaining member with respect to the longitudinal axis of the ski. An arrangment of this character is disclosed notably in the French Pat. No. 2,021,055 or in the published German Pat. Nos. 2,659,369 and 2,027,412.

Now these devices are generally complicated, notably because, during the pivotal movement of the sole retaining member, the spring of the resilient mechanism is also exposed to a certain degree of backlash or deflexion following the movement of the sole retaining member, which is detrimental to a proper mechanical operation and a long useful life. Moreover, it is rather difficult to assembly the component elements of a heel hold-down device of this type without jeopardizing its fluid-tightness, which is absolutely necessary to prevent the ingress of water, snow, or ice, which would be detrimental to the proper operation of the moving parts.

OBJECT OF THE INVENTION

It is the primary object of the present invention to provide an improved heel hold-down device for safety ski bindings which comprises a fixed body, a pivoting heel retaining member or retainer, a control lever, and a resilient mechanism disposed between the body and the heel retainer, this assembly being considerably simpler and more reliable than hitherto known prior art devices of this character.

SUMMARY OF THE INVENTION

For this purpose, the heel hold-down device for ski bindings according to the instant invention comprises a fixed body adapted to be locked in an adjustable position along the ski axis. The fixed body has two vertical lateral walls and an inner cavity open at one end and closed at the opposite end along the ski axis. A heel retaining member is adapted to pivot about a transverse horizontal axis on the fixed body and to cover the fixed body by means of a pair of side wings parallel to the lateral walls of the fixed body. The heel hold-down device is responsive to a spring-loaded resilient mechanism carried by the fixed body and housed in the inner cavity thereof. The spring of the resilient mechanism reacts with one end against the closed end of the inner cavity and with the opposite end against a U-shaped piston of which the central portion closes the open end of the inner cavity. The two flat parallel arms of the U-shaped piston are in sliding contact with the lateral walls of the fixed body, and the side wings of the heel retainer are also parallel to the arms of the U-shaped piston. The heel retaining member is pivotally mounted to the arms about a pair of axially aligned and opposed pivot pins or screws engaging registering and aligned holes formed in the wheel retainer wings. The piston arms, the pivot pins, or the screws are adapted to slide in elongated longitudinal holes formed in the lateral faces of the fixed body.

In a first embodiment of the present invention, the control lever is pivoted to the fixed body about a pivot axis parallel to the transverse axis about which the heel retaining member is mounted on the fixed body. The control lever comprises an upswept arm adapted to bear against a registering surface of the heel retaining member. Depressing the control level lifts the heel retainer surface and causes the heel retainer to pivot upwards. During this movement, as a consequence of the pivotal mounting of the heel retainer on the piston, the piston is caused to move towards the heel retainer in relation to the fixed body, thus compressing the spring of the resilient mechanism.

The heel retaining member may advantageously comprise a ramp adapted to cooperate with a transverse roller carried by the fixed body. The ramp has a substantially rounded contour having extensions at both ends which provide two hollow areas defining two stable positions of the heel retainer—namely, a lower position and an upper position with respect to the fixed body, respectively.

In another embodiment, the control lever is pivoted to the heel retaining member about pivot pins also acting as pivot means for the heel retainer with respect to the U-shaped piston. The control lever further comprises a pair of axially aligned and opposed internal studs extending transversely and in sliding contact with lateral bearing surfaces formed on the fixed body in front of each stud. When the control lever is actuated, the pressure exerted by the studs on the bearing surfaces causes the forward movement of the piston. Preferably, the pair of studs of the control lever engage matching open grooves of the heel retainer when the latter is in its lower position. Also preferably, the bearing surfaces engaged by the studs of the control lever are formed in the sides of a metal strap straddling the fixed body and bearing against a flat shoulder protruding from the fixed body.

In a third embodiment of the present invention, the control lever is pivoted to the heel retainer about a transverse axis disposed externally of the fixed body. The control lever comprises a nose portion consisting of two flat lateral extensions covering the lateral faces of the fixed body and adapted, when the control lever is actuated, to slide on the two ends of a rod parallel to the transverse axis of the fixed body. The two ends have extensions in the form of rollers engaging curved grooves formed in the parallel wings of the heel retainer, respectively.

According to a specific feature characterising the present invention and irrespective of the embodiment contemplated, as far as the pivotal mounting of the heel retaining member on the U-shaped piston is concerned, the fixed body comprises, beneath the cavity enclosing the spring of the resilient mechanism, a recess opening towards the ski surface and receiving therein a member for locking the body in the selected position with respect to a fixed rack secured to the ski. The locking member comprises a lug pivoting about a pin and responsive to a spring wire coiled around the pin and having two ends engaging the fixed body and the lug, respectively. The lug comprises at its lower end a tooth adapted to engage the fixed rack in a position selected according to the rack length. Preferably, the lug tooth bears agains the end of a very stiff steel member or blade overlying the fixed rack and having one end secured to the fixed body and the other end engaged in a notch of the fixed rack against which the stiff member or blade is urged by the lug.

Moreover, and according to another specific feature characterising the invention which is already known per se, but which is incorporated in the heel retainer in combination with the other features descirbed hereinabove, the central portion of the U-shaped piston has a hole formed therein which receives a standing set screw engaging a flat nut on which the end of the spring of the resilient mechanism is caused to bear. Thus, when the standing set screw is rotated, the nut position with respect to the central portion of the U-shaped piston permits the initial setting of the spring compression. The flat nut may advantageously comprse a bent portion parallel to the upper face of the fixed body which comprises a window through which the skier can read a scale etched, printed, or otherwise formed on the bent portion to display the degree of compression of the spring as a function of the nut position.

Other features of the heel retaining device for a safety ski binding according to the present invention will appear as the following description proceeds with refernce to the attached drawings showing various embodiments of the invention given by way of example, not of limitation.

BRIEF DESCRIPTION OF THE DRAWINGS

FIG. 2 is a cross section taken along the line II—II of FIG. 1.

FIG. 8 is a cross-sectional view of the heel hold-down device of FIG. 7, the section being taken along the line VIII—VIII of FIG. 7.

DESCRIPTION OF THE PREFERRED EMBODIMENTS

The First Embodiment

Figure 1:
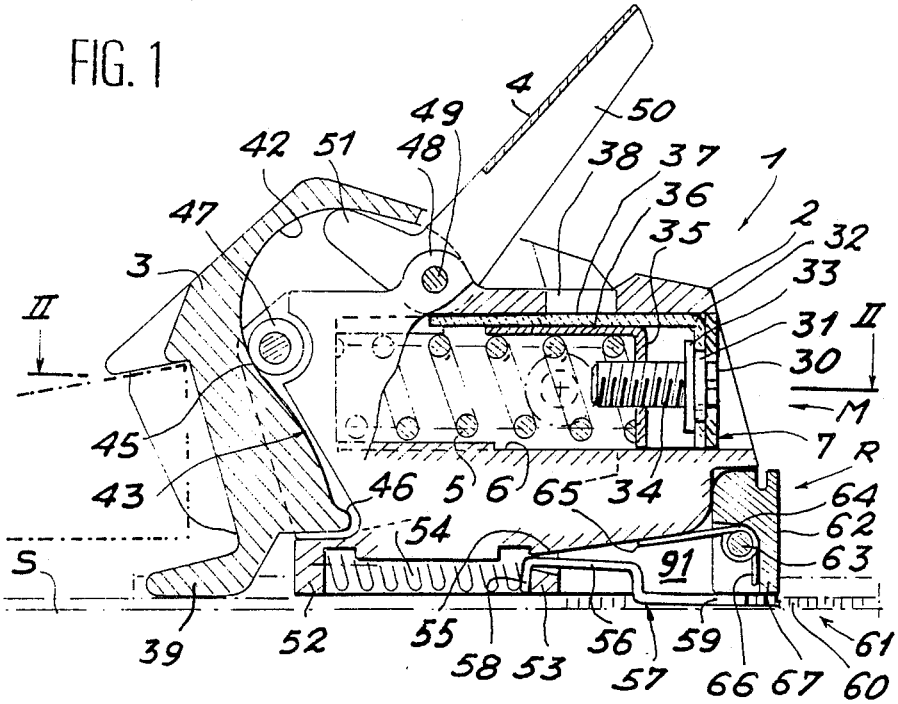
FIG. 1 is a longitudinal sectional view showing the heel retaining device according to a first embodiment of the invention.

Referring first to the embodiment shown in FIGS. 1–4 of the drawings, the heel hold-down device according to the present invention, as illustrated therein and designated in general by the reference numeral 1, comprises a fixed body or support 2 of substantially parallelipipedal configuration, a pivoting heel retaining member 3 having two lateral wings 3*a*, 3*b* respectively and covering the lateral faces of the fixed body 2, and a control lever 4. The fixed body 2 is locked in relation to the ski surface S by means of an adjustable positioning device R to be described in detail presently. The fixed body 2 incorporates a resilient mechanism M comprising a coil spring 5 housed in a cavity 6 formed in the fixed body 2 and extending in the longitudinal direction of the ski. The compression spring 5 is associated in a manner to be described hereinafter with a U-shaped piston 7 of which the configuration is shown more in detail in the horizontal section of FIG. 2.

The fixed body 2 comprises a transverse or end wall 8 opposite the U-shaped piston 7 and against which the inner end of the coil spring 5 of the resilient mechanism M is adapted to bear. The cavity 6 is defined by a pair of spaced vertical parallel flat faces 9, 10, respectively, of the fixed body 2. The flat faces 9, 10 are in prolongation of the transverse wall 8 and extend rearwardly. The end 11 of the cavity 6 which is opposite the transverse wall 8 has an aperture formed therein which registers with the central portion 12 of the U-shaped piston 7. The U-shaped piston 7 comprises in turn a pair of flat lateral arms 13, 14 parallel to the flat faces 9, 10 of the fixed body 2.

According to the invention, each lateral arm 13, 14 of the U-shaped piston 7 has a pair of elongated key-holes 15, 16 formed therethrough, respectively. By virtue of a particular configuration, the elongated key-holes 15, 16 permit the passage of two trunnions 17, 18 therethrough, as shown in FIGS. 3 and 6 illustrating more particularly the shape of the trunnions 17, 18 and the manner in which they are fitted to the U-shaped piston 7.

Figure 3:
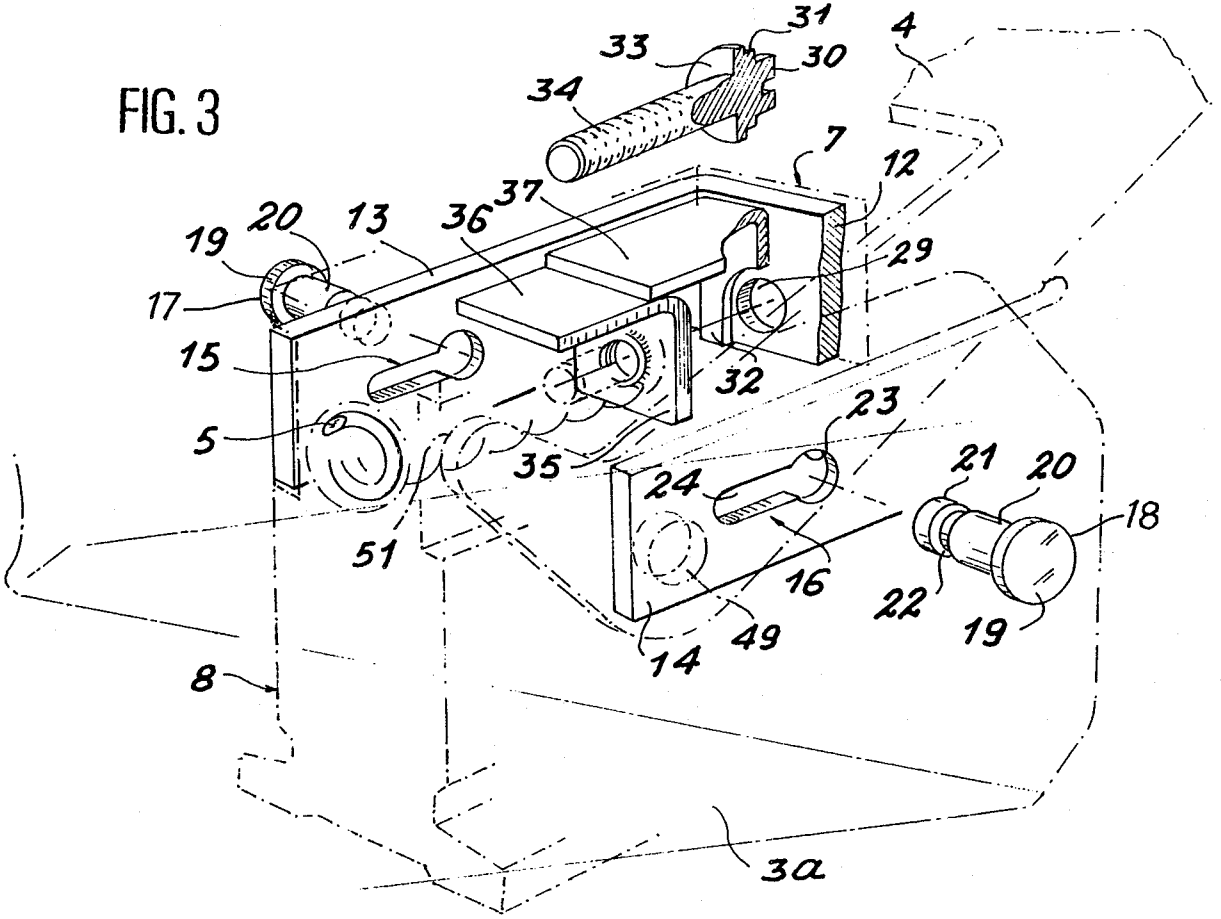
FIG. 3 is a detail perspective exploded and phantom view showing more particularly the U-shaped piston of the improved heel retaining device of the embodiment of the present invention shown in FIGS. 1 and 2, and the pivot pins for mounting the heel retainer and its control lever on the piston.
Figure 6:
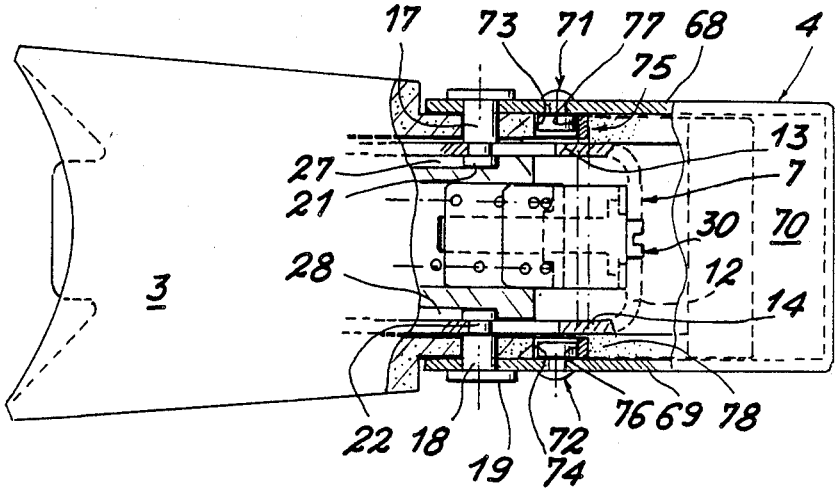
FIG. 6 is a plan view from above with parts broken away, showing the heel hold-down device according to the embodiment of FIG. 5.

As clearly shown in FIGS. 3 and 6, each trunnion 17 or 18 comprises notably a flat, shallow head 19, a body 20, an end portion 21 having substantially the same cross-section as the body 20, and, intermediate the body 20 and the end portion 21, a circular groove 22 of a width corresponding substantially to the thickness of each lateral arm 13 or 14 of the U-shaped piston 7.

The elongated keyholes 15, 16 formed in each lateral arm 13, 14 of the U-shaped piston 7 comprise two adjacent portions, 23, 24. The first portion 23 is circular and has a diameter somewhat greater than the diameter of the body 20 of each trunnion 17, 18. The second portion 24 is elongated and of smaller width, permitting the engagement and holding of the corresponding lateral arm 13, 14 of the U-shaped piston 7 in the circular groove 22. This arrangement, as is clearly apparent from the Figures, permits assembling of the trunnions 17, 18 with the U-shaped piston 7 and, in a first step attended by a limited compression of the coil spring 5, the engagement of the end portions 21 in the first portion 23 of the corresponding elongated key-hole 15 or 16. Then, following a slight movement in a direction parallel to the longitudinal dimension of the lateral arms 13, 14 and the expansion of the compression spring 5, the second portion 24 slides in the circular groove 22.

Once the trunnions 17 and 18 are fitted in position, the heel retaining member 3 can be pivotally mounted on the U-shaped piston 7. The heel retaining member 3 comprises for this purpose lateral recesses 25, 26 adapted to receive the flat, shallow heads 19 of the trunnions 17, 18. The lateral recesses 25, 26 are formed in the lateral wings **3*a* and 3*b*, respectively, of the heel retaining member 3 which substantially cover the fixed body 2 parallel to the flat faces 9 and 10 thereof. Moreover, to permit the movement of the assembly consisting of the heel retaining member 3 and the U-shaped piston 7 thus assembled by the trunnions 17, 18 in relation to the fixed body 2, the fixed body 2 has longitudinal slots 27, 28 formed in the outer surface of its lateral flat faces 9, 10 which permit the longitudinal sliding movement of th end portions 21 of the trunnions 17, 18**.

The U-shaped piston 7 comprises in its central portion 12 a hole 29 substantially aligned with the axis of the coil spring 5 for receiving the head of a screw 30 constantly held against the central portion 12 of the U-shaped piston 7. For this purpose, the screw 30 has a collar extension 31 extending beyond the central portion 12 and engaged by a strap 32 locked against the central portion 12 by a shoulder 33 of the screw 30. The screw-threaded portion 34 of the screw 30 is engaged by a relatively flat, thin nut 35 acting as a stop. The pressure of the outer end of the coil spring 5 is exerted against the nut 35 disposes between the lateral arms 13 and 14 of the U-shaped piston 7. The position of the nut 35 can be adjusted by rotating the screw 30, so that a predetermined spring force can be set.

According to an advantageous feature of the invention and as shown in FIG. 1, the nut 35 comprises an upper portion 36 bent at right angles and extending parallel to the upper surface of the fixed body 2. The strap 32 comprises in turn a flat portion 37 parallel to and overlying the upper portion 36. The flat portion 37 consists preferably of transparent material, notably of the Plexiglass type, and has printed or etched thereon reference numerals or scales. Preferably the upper portion 36, which is adjustable in the longitudinal direction with respect to the nut 35, has an index mark printed or etched thereon so that the user can check at any time the initial compressive force of the coil spring 5 and thus set the threshold beyond which the heel hold-down device of the safety ski binding is released by simply looking through a window 38 formed for this purpose in the fixed body 2 and then turning the screw 30.

The heel retaining member 3 of the heel hold-down device is also made in a manner known per se in this specific technical field and comprises notably at its lower end normally contacting the ski surface S a lug 39 engageable under the heel of the ski boot (not shown). The heel hold-down device 1 also comprises a pair of laterally spaced side jaws 40, 41 overlying the lug 39 (FIG. 2) and adapted to engage the upper edge of the sole, so that the boot heel can normally be locked in position.

The heel retaining member 3 further comprises, in its portion registering with the fixed body 2, a cavity 42 (FIGS. 1 and 4) having in its lower half a bearing ramp 43 consisting of a slightly rounded central portion 44 and two hollow portions 45, 46 disposed above and below the central portion 44. The portions 44, 45, 46 are normally engaged by a roller 47 carried by the fixed body 2 and rolling on the bearing ramp 43 during the upward tilting movement of the heel retaining member 3 when moving from the locked position shown in FIG. 1 to the release porition shown in FIG. 4.

The tilting movement of the heel retaining member 3 may thus be obtained either manually by actuating the control lever 4 when the skier wants to take off his ski and remove the boot from the safety ski binding, or automatically, notably in case of a forward fall of the skier. In the latter case, the skier exerts a substantial upward thrust on the heel, and this causes likewise a corresponding tilting movement of the heel retaining member 3, which releases the ski boot from the ski.

In the embodiment shown in FIGS. 1–4, the control lever 4 is fulcrumed on a transverse pivot pin 49 fitted in a boss 48 projecting above the upper surface of the fixed body 2. The control lever 4 comprises an arm 50 permitting its actuation. Opposite the arm 50, with respect to the pivot pin 49, a bent lug 51 engages the bottom of the cavity 42 of the heel retaining member 3. It is therefore clear that, when the control lever 4 is actuated in the clockwise direction from the position shown in FIG. 1 to the position shown in FIG. 4, the lug 51 will exert an upward pressure against the heel retaining member 3, thus enabling the roller 47 to move down the bearing ramp 43 from the upper hollow portion 45 to the lower hollow portion 46, in which the roller 47 is in its upper position.

During the tilting movement and according to a specific feature of the present invention, the heel retaining member 3 performs in conjunction with the U-shaped piston 7 a complementary forward movement, as a consequence of the pivotal coupling between the heel retaining member 3 and the U-shaped piston 7. This is accomplished through the trunnions 17 and 18 which, while the heel retaining member 3 is being pushed forwards by the bearing ramp 43 against the resilient force of the compression spring 5, slide in the longitudinal slots 27 and 28 formed in the lateral vertical faces 9 and 10 of the fixed body 2.

With this arrangement, the heel retaining member 3, during its rotation about the trunnions 17 and 18, is carried along by the U-shaped piston 7, to which it is coupled by the trunnions 17, 18, so as to follow the movement of the ski boot heel during the boot take-off step, whether this operation is controlled by the control lever 4 or caused by the release of the safety binding in case of a fall of the skier. This structure also affords an increment in the amplitude of the so-called "resilient stroke" of the heel hold-down device by warranting, during the movements of the ski boot heel on the one hand and of the heel retaining member 3 on the other hand, the holding of these two elements in mutual contact along a considerably longer stroke, though they move in opposite directions, thus improving considerably the safety of the binding under release conditions.

Of course, the operation of the heel retaining member during its upward tilting movement as depicted hereinabove is independent of the position of the fixed body 2 with respect to the ski surface S, this position being adjustable by means of the adjustment device R according to the ski boot size in order to provide a sufficient gap between the toe end device of the binding (not shown) and the heel hold-down device for facilitating the insertion of the ski boot.

Figure 4:
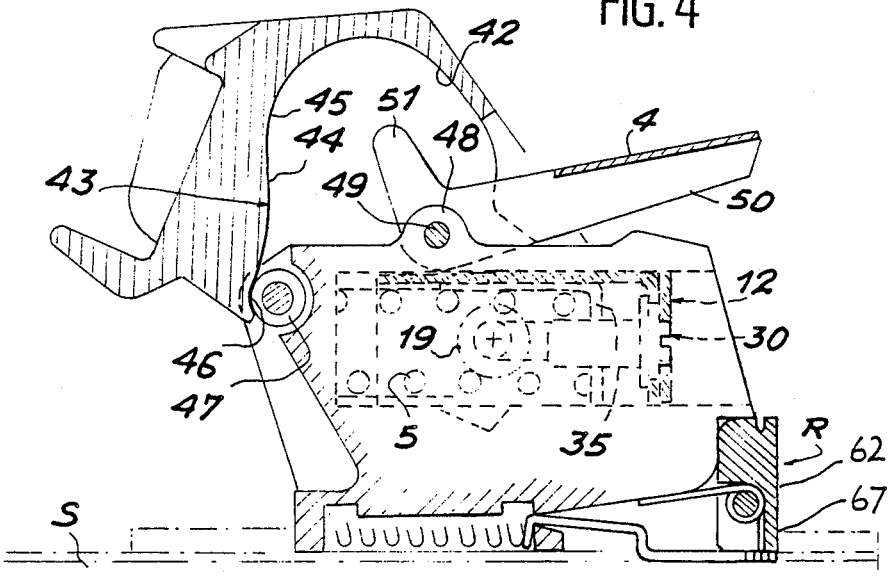
FIG. 4 is another longitudinal section, similar to FIG. 1, but showing the pivotal heel retainer in its upmost tilted position.

The adjustment mechanism R provided for this purpose is enclosed in a housing 91 formed in the lower portion of the fixed body 2 adjacent the ski surface S. The housing 91 is defined at the front by a pair of abutment elements 52, 53 between which a coil compression spring 54 is disposed. In the abutment element 53, a passage 55 is provided for receiving the end 56 of an elastic member or blade 57. The end 56 comprises, between the abutment elements 52, 53, a turned-down lip 58 engaged by the rear end of the compression spring 54 and permitting the resilient longitudinal mounting of the blade 57. The blade 57 has a zig-zag configuration and is bent as shown in FIGS. 1 and 4. It comprises at its rear end (opposite the turned-down lip 58) an extension 59 of which the end edge is adapted to engage one tooth 60 of a rack 61 secured to the ski surface S, the rack 61 extending longitudinally in relation to the ski. Thus, according to the longitudinal position of the tooth 60 engaged by the rear edge of the extension 59, the fixed body 2 can be locked in the selected longitudinal position. In fact, the compression spring 54 urges the blade 57 laterally and tends to cause the blade 57 to pivot upwards. The extension 59 of the blade 57 is normally locked with respect to the selected tooth 60 of the rack 61, this locking being accomplished by means of a latch 62 fulcrumed on a transverse pin 63 carried by the fixed body 2 with the interposition of a hairpin spring 64 bearing with one end 65 against the bottom of the housing 91 and with the other end 66 agaisnt a tooth-forming extension 67 of the latch 62, in the downward direction, towards the extension 59 of the blade 57. In the position shown in FIG. 1, the latch 62 is raised, and the extension 67 bears against the extension 59 of the blade 57 so as to lock the extension 67 in the selected notch 60. In contrast thereto, in the position shown diagrammatically in chain lines in FIG. 4, the latch 62 is tilted backwards to a postion in which the extension 67 releases the blade 57, thus permitting the free sliding movement of the fixed body 2 along the rack 61.

The Second Embodiment

Figure 5:
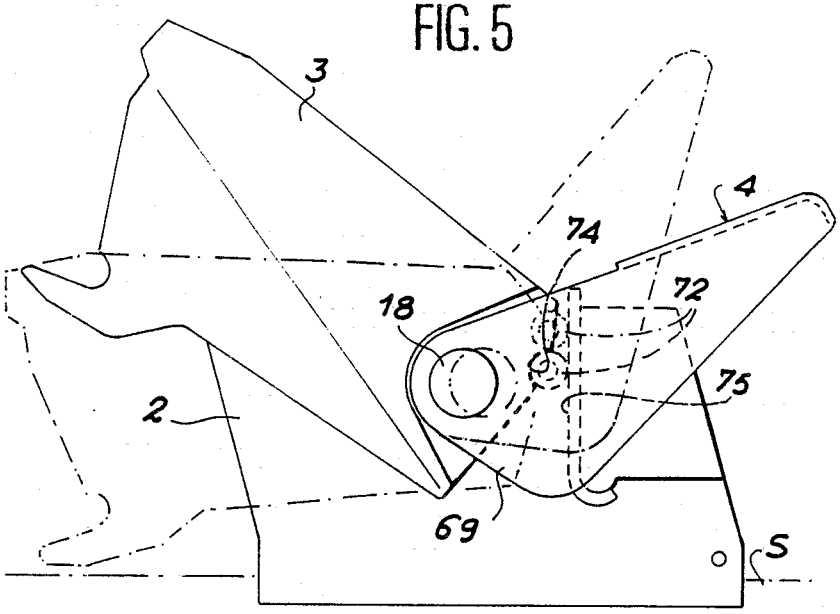
FIG. 5 is a diagrammatic side elevational view of a second embodiment of the heel hold-down device of this invention.

FIG. 5 illustrate a second embodiment which, while retaining many of the features illustrated in the preceding figures (notably in connection with the pivotal mounting of the heel retaining member 3 on the U-shaped piston 7 mounted for axial sliding movement on the body 2) provides different constructional arrangements.

Thus, in this modified version, the control lever 4 has the general configuration of an elongated triangle. As seen from above (FIG. 6), a pair of lateral plates 68, 69 are interconnected by a transverse wall element 70. The control lever 4 carries in the lateral plates 68, 69, a pair of registering aligned lateral studs 71, 72 which, in the lower position of the heel retaining member 3, engage grooves 73, 74 formed in the corresponding registering portion of the heel retaining member. The heel retaining member 3 is pivoted to the U-shaped piston 7 by means of the trunnions 17 and 18 already mentioned with reference to the first embodiment.

In this second embodiment, the lateral studs 71 and 72 carried by the control lever 4 engage a strap 75 disposed in a transverse plane on the fixed body 2 and provided with two bearing surfaces 76 and 77 engaged by the lateral studs 71, 72, respectively. The strap 75 normally bears in turn against an abutment shoulder 78 formed in the rear portion of the fixed body 2.

Thus, during the tilting movement of the control lever 4 in the clockwise direction, the lateral studs 71 and 72 are caused to slide on the bearing surfaces 76 and 77, respectively. The lateral studs 71, 72 thus exert a combined effort which is the resultant of an upward movement and of a forward movement, the forward movement being again permitted by the movement of the trunnions 17 and 18 in the longitudinal slots 27 and 28 formed in the lateral surfaces 9 and 10 of the fixed body 2.

The Third Embodiment

Figure 7:
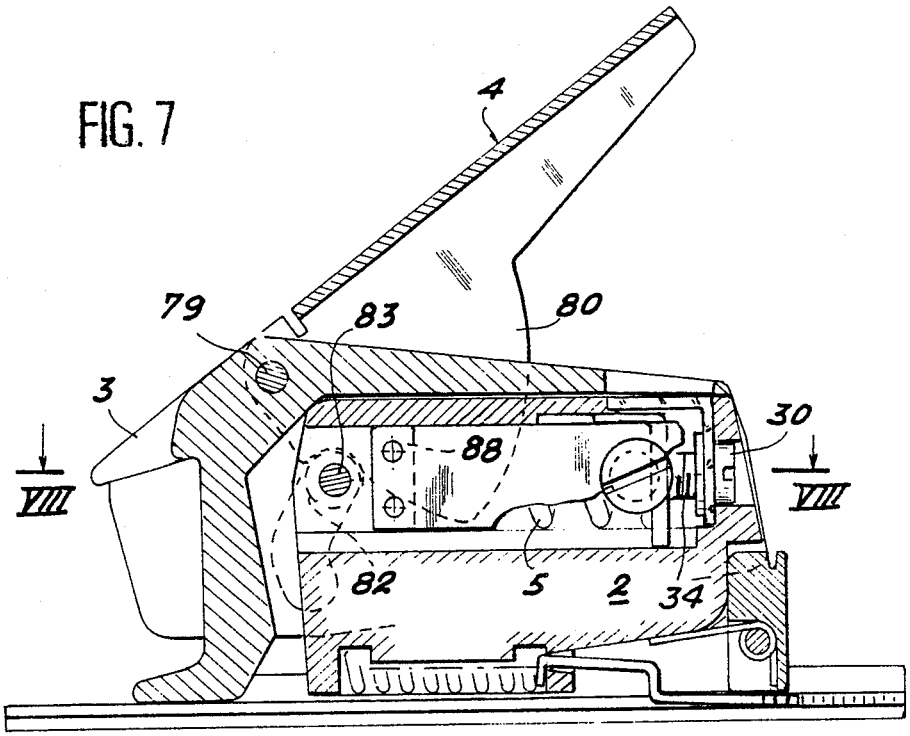
FIG. 7 is a longitudinal section showing a third embodiment of the device in its operative or lower position.
Figure 9:
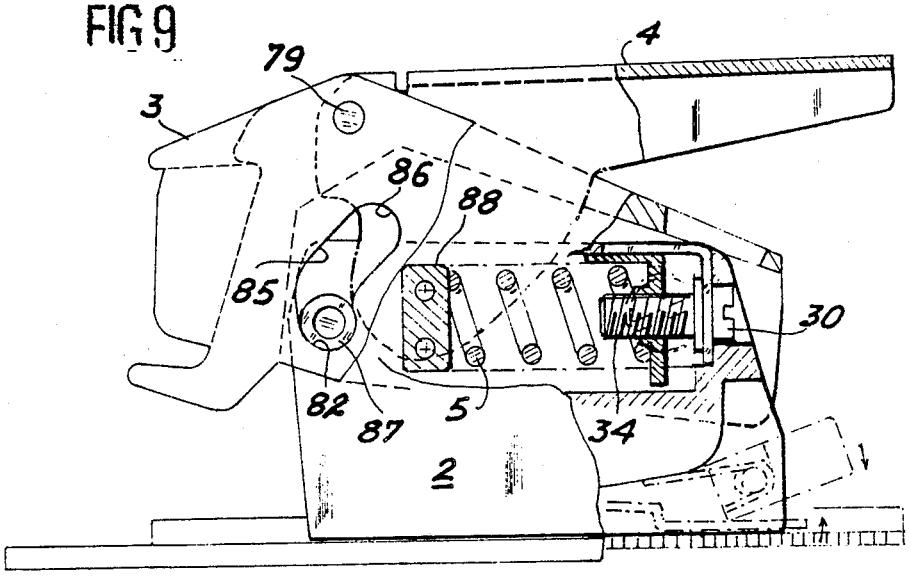
FIG. 9 is a side-elevational view, with parts broken away, of the heel hold-down device of FIG. 7, showing the device in the position corresponding to the maximal upward tilting movement of the pivoting heel retaining member.

In a third embodiment illustrated in FIGS. 7–9, the control lever 4 is fulcrumed directly on the heel retaining member 3 by means of a transverse pivot pin 79. The control lever 4 further comprises on either side of the fixed body 2 a pair of depending flat parallel cam lobes 80 (of which only one is visible in FIGS. 7 and 9) engaging a pair of rollers 81 and 82, respectively, carried by a rod 83 extending through the fixed body 2 in the rear portion 84 thereof.

Each roller 81, 82 engages in turn a groove such as 85 formed in the corresponding lateral walls 3a and 3b respectively of the heel retaining member 3. The grooves 85 have a bent profile with two inclined planes leading to two areas acting as end stops 86 and 87 for the heel retaining member 3, respectively, in the lower position as shown in FIG. 7 or in the uppermost tilted position as illustrated in FIG. 9, respectively.

However, in the third embodiment, the upward tilting movement with respect to the fixed body 2 is attended, for the heel retaining member 3 and the U-shaped piston 7 associated therewith, by a backward movement of the ski S, in contrast to the arrangements of the preceding embodiments. In fact, due to the specific contour of the gooves 85 receiving the rollers 81 and 82, the tilting movement of the heel retaining member 3 causes an effort to be exerted via its trunnions 17 and 18 on the U-shaped piston 7, so that the U-shaped piston 7 is caused to recede and thus compress the coil spring 5 of the elastic mechanism M. For this purpose, the elastic mechanism M comprises a transverse bearing surface 88—in this case, the central portion 12 of the U-shaped piston 7 which interconnects the lateral arms 13 and 14 thereof. In this embodiment, as illustrated in FIG. 8, the transverse wall 8 of the fixed body 2 faces the rear end of the ski, and the screw 30 is carried directly by the transverse wall 8 to permit the adjustment of the initial compression of the coil spring 5 and the threshold where at the heel hold-down device will releas the ski boot, as already mentioned and described in the foregoing.

In the third embodiment, the compression spring 5 may be somewhat weaker than the spring of the preceding embodiments, due to the shifting of the center of rotation of the heel retaining member 3 to the rear end of the heel hold-down device. Thus, during the boot release movement, the heel retaining member 3 recedes, and consequently the effect resulting from a forward thrust is reduced appreciably. As a result, the undesired frictional contact with the toe device of the safety ski binding is limited in case of a fall. Additionally, fitting the ski boot in the heel hold-down device is greatly facilitated, since this device is moved forwards during the insertion of the ski boot into the safety ski binding.

Whatever the form of embodiment contemplated, the original arrangements according to the present invention, which provide a direct coupling between the heel retaining member 3 and the U-shaped piston 7 carried by the fixed body 2 (which is nevertheless movable against the resistance of the elastic mechanism M), are characterised by particualarly advantageous features. Thus, the pivotal mounting of the heel retaining member 3 on the U-shaped pistion 7 may in all cases be disposed closer to the upper surface of the fixed body 2 in order to increase the resilient stroke of the heel hold-down device while preserving a substantially rectilinear path of the heel hold-down device wherein the center of rotation of the heel retaining member as well as its point of contact with the safety ramp lie substantially on the same line, thus warranting a considerably simpler and particularly a more reliable mechanical operation of the system. Moreover, with these arrangements, the heel retaining member may be designed so that, due to the provision of the lateral walls of the heel retaining member and of the trunnion receiving holes, the heel hold-down device has a good fluid-tightness in relation to the fixed body, thus preventing notably ice or snow from pentrating into the mechanism and interferring with, or even preventing, its proper operation.

Of course, and as will be clearly apparent from the foregoing, the present invention should not be construed as being strictly limited by embodiments described and illustrated herein, which are given by way of example, since many modifications and changes may be brought thereto without departing from the basic principles of the invention.

What is claimed is:

1. A heel hold-down device for a safety ski binding, which comprises a fixed body locked in a position adjustable along the longitudinal axis of the ski, said body of substantially parallelipipedic configuration having two lateral vertical walls and comprising an internal cavity open at one end and closed at the other end in the axial direction of the ski, a heel retaining member fulcrumed on a transverse pivot pin carried by said fixed body, said heel retaining member end closing said body with a pair of wings parallel to said lateral vertical walls of said body, said heel retaining member being responsive to a spring-loaded elastic mechanism carried by said fixed body and housed in said internal cavity of said body, wherein the spring of said elastic mechanism is a coil compression spring reacting with one end against the closed end of said cavity and with the opposite end against a movable U-shaped piston of which the intermediate portion closes the open end of said cavity and the two lateral arms are flat and adapted to slide parallel to said lateral walls of said fixed body, the lateral walls of said heel retaining member being also parallel to the arms of said U-shaped pistion, said heel retaining member being pivotally mounted on said piston arms by means of a pair of axially aligned, opposite and registering trunnions screws extending through registering keyhole-shaped apertures formed in said wings of said heel retaining member and said lateral arms of said piston, said trunnions or screws being slidably engaged in longitudinal slots formed in the lateral surfaces of said fixed body.

2. The heel hold-down device of claim 1, wherein said control lever is fulcrumed on said fixed body by means of a pivot pin parallel to the transverse axis of said heel retaining member on said body and comprises a bent lug at one end, adapted to bear agianst a registering inner surface of the cavity of said heel retaining member, whereby when said control lever is depressed said lug is raised and said member is tilted upwards.

3. The heel hold-down device of any of claims 1 or 2, wherein said heel retaining member has formed in its cavity an inclined ramp engaged by a roller rotatably mounted on said fixed body, said ramp having a substantially curvilinear contour with hollow end portions providing two opposite stable end positions for said heel retaining member, respectively a lower position and an upper position with respect to said fixed body.

4. The heel hold-down device of claim 1, wherein said control lever is fulcrumed on said heel retaining member by means of said trunnions on which said heel retaining member is fulcrumed in turn in relation to said U-shaped piston, said control lever further comprising a pair of axially aligned lateral opposed studs extending across said lever and having an internal portion is sliding bearing contact with lateral surfaces extending substantially vertically in front of each stud on said fixed body, whereby the tilting movement of said control lever about said trunnions is attended by a forward movement of said piston as a consequence of the bearing contact between said studs and said lateral surfaces.

5. The heel hold-down device of claim 4, wherein said pair of studs of said control lever also engage corresponding open grooves formed in said heel retaining member when this member is in its lower position.

6. The heel hold-down device of claim 4, wherein said lateral bearing lateral surfaces engaged by said studs are formed in the lateral sides of a metal strap straddling said fixed body and urged against a projecting flat shoulder formed on said fixed body.

7. The heel hold-down device of claim 1, wherein said control lever fulcrumed on said heel retaining member on a transverse pivot pin disposed externally of said fixed body comprises a cam lobe consisting of a pair of lateral flat extensions disposed on either side of said fixed body and in sliding contact, during the actuation of said control lever, with the two ends of a rod parallel to said transverse pivot pin, said two ends having extensions in the form of rollers engaging curved cam grooves formed in each one of said parallel lateral walls of said heel retaining member.

8. The heel hold-down device of any claims 1–7, wherein said fixed body comprises, beneath the cavity containing the spring of said elastic mechanism, a recess opening towards the ski surface and receiving a member adapted to lock said body in relation to a rack secured to the ski, said locking member consisting of a latch fulcrumed on a transverse pin and urged by a hairpin spring pivoted to said transverse pin, the ends of said hairpin spring engaging the one said body and the other said latch, said latch being provided at its bottom end a tooth adapted to engage one notch of said rack in the position selected along said rack.

9. The heel hold-down device of claim 8, wherein said tooth of said latch bears on one end of a metal blade overlying said rack and having one end secured to said fixed body and its other end normally urged by said latch for engagement in one notch of said rack.

10. The heel hold-down device according to any of claims 1–9, wherein the central portion of said U-shaped piston has a hole formed therethrough which is engageable by a captive set screw threaded in a flat nut resiliently engaged by the adjacent end of said coil compression spring of said elastic mechanism, so that the nut position and consequently the initial value of the spring compression can be set by rotating said screw.

11. The heel hold-down device of claim 10, wherein said flat nut has a bent portion parallel to the upper surface of said fixed body in which a window registering with said bent portion is provided, a scale being etched or printed on said bent portion for displaying the degree of compression of said spring as a function of the nut position.

* * * * *